US006135744A

United States Patent [19]

Andersen et al.

[11] Patent Number: 6,135,744

[45] Date of Patent: Oct. 24, 2000

[54] PISTON UNLOADER ARRANGEMENT FOR SCREW COMPRESSORS

[75] Inventors: Garry E. Andersen, La Crosse, Wis.; Robert A. Mayfield, Pueblo West, Colo.

[73] Assignee: American Standard Inc., Piscataway, N.J.

[21] Appl. No.: 09/070,827

[22] Filed: Apr. 28, 1998

[51] Int. Cl.[7] ..... F01C 1/16

[52] U.S. Cl. ..... 418/201.2

[58] Field of Search ..... 418/201.2

[56] References Cited

U.S. PATENT DOCUMENTS

| | | | |
|---|---|---|---|
| 4,042,310 | 8/1977 | Schibbye et al. | 417/310 |
| 4,544,333 | 10/1985 | Hirano | 417/299 |
| 4,565,508 | 1/1986 | Lindstrom | 418/201 |
| 5,203,685 | 4/1993 | Andersen et al. | 418/1 |
| 5,211,026 | 5/1993 | Linnert | 62/175 |
| 5,979,168 | 11/1999 | Beekman | 418/201.2 X |

FOREIGN PATENT DOCUMENTS

| | | | |
|---|---|---|---|
| 631435 | 7/1962 | Italy | 418/201.2 |

*Primary Examiner*—Hoang Nguyen
*Attorney, Agent, or Firm*—William J. Beres; William O'Driscoll; Peter D. Ferguson

[57] ABSTRACT

A screw compressor employs a piston unloader disposed in a bore remote from the compressor's working chamber. Flow communication between the bore and working chamber is through a series of unloader ports. The unloader piston has an end portion of uniform geometry which causes the physically non-overlapping unloader ports to, in effect, overlap in operation and is such that the unloader piston need not be maintained in any specific orientation within the bore in which it resides in order to unload the compressor in a continuous fashion.

16 Claims, 2 Drawing Sheets

FIG. 1
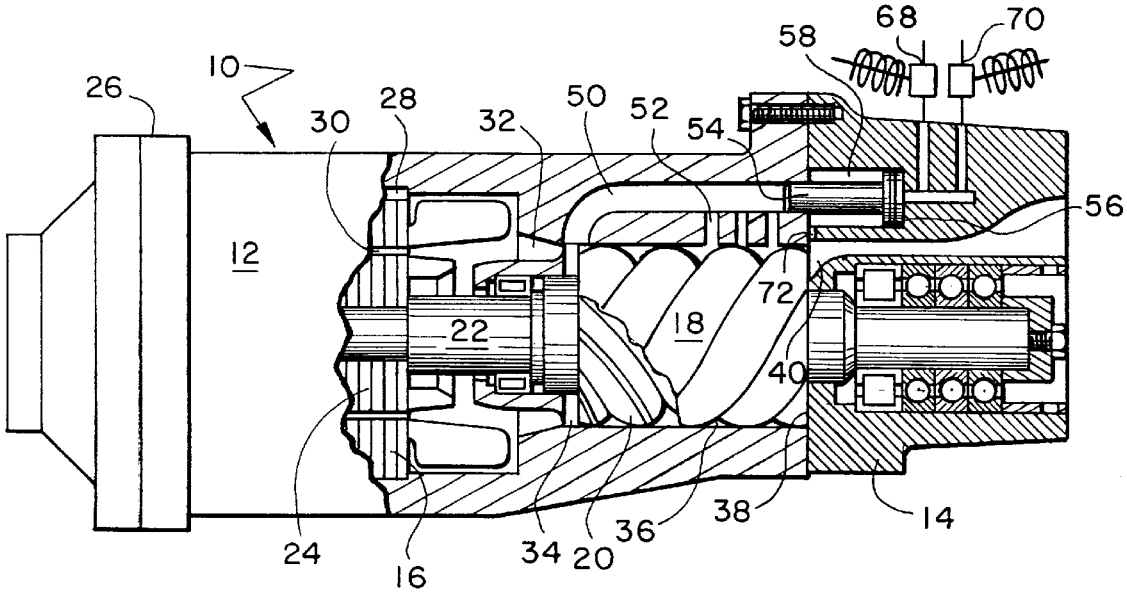
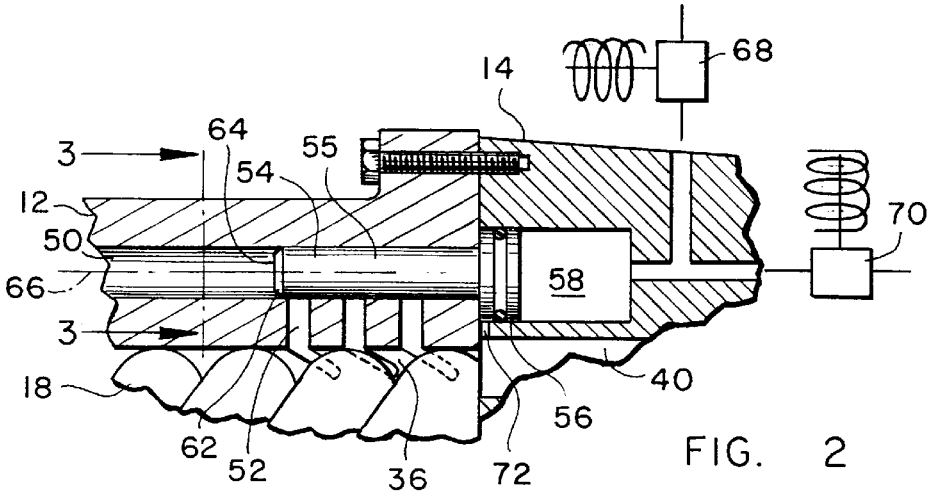
FIG. 2
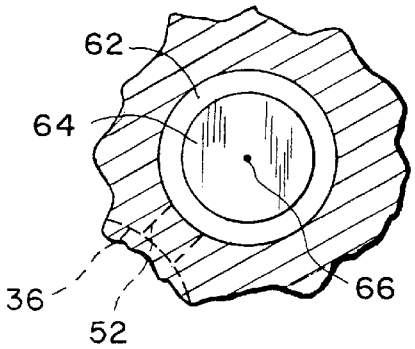
FIG. 3

PISTON UNLOADER ARRANGEMENT FOR SCREW COMPRESSORS

BACKGROUND OF THE INVENTION

The present invention relates to apparatus for increasing and decreasing the pumping capacity of a rotary screw compressor. More particularly, the present invention relates to an unloading arrangement for a refrigeration screw compressor characterized by the disposition of an unloading piston in a cylindrical bore which is remote from the compressor's working chamber but which is in flow communication with the working chamber through a series of unloader ports.

A compressor used in a refrigeration system is caused to "load" when the cooling demand placed on the evaporator of the system in which the compressor is employed increases. When the cooling demand decreases, the compressor is caused to "unload". When the load is higher, the evaporator will produce vaporized refrigerant gas at a higher rate than when the load is lower. The "load" on a compressor in a refrigeration system is therefore a function of the demand for cooling placed on the system in which the compressor is employed at any given time and is manifested in the amount of vaporized gas that the compressor is called upon to pump from the evaporator for reconditioning and re-use in the cooling process.

The screw compressor unloading arrangements of the type illustrated in U.S. Pat. Nos. 4,042,310; 4,544,333; 4,565,508; 5,203,685; and, 5,211,026, the latter two of which are assigned to the assignee of the present invention, are unloading arrangements which employ an axially moveable or rotatable unloading piston disposed within a cylindrical bore remote from the compressor's working chamber. Such unloaders are to be distinguished from "slide valve" unloaders which are more commonly used to unload screw compressors of larger capacities.

The remote bore in which piston unloaders travel communicates with the compressor's working chamber through a series of unloader ports that are aligned along the length of and open into both the unloader bore and the compressor's working chamber. Additionally, the unloader bore is in flow communication with a portion of the compressor which is at suction pressure when the compressor is in operation.

The piston unloader arrangement in co-assigned U.S. Pat. No. 5,203,685, which is incorporated herein by reference, is such that by specially configuring the geometry of a segment of the end face portion of the unloader piston and by providing apparatus by which to maintain the angular orientation of that specially configured end face portion with respect to the series of physically non-overlapping unloader ports spaced axially down the unloader bore, the unloader ports, in effect, become overlapping ports in operation while sealing within the unloader bore around the circumference of the unloader piston is accomplished. Continuous unloading of the compressor in an efficient manner is thereby achieved while internal leakage within the compressor attributable to the piston unloader arrangement is reduced.

The arrangement of the '685 patent, while an improvement over prior arrangements, requires, as noted above, the special configuration of a segment of the end face portion of the unloader piston and maintenance of a specific orientation of the unloader piston within the unloader bore in order to precisely align the specially configured end face portion with the unloader ports. The need therefore exists for a simplified and less orientation-critical arrangement for a piston unloader in a screw compressor in order to reduce parts cost, reduce alignment criticality, simplify assembly and reduce the number of potential failure modes associated with such unloader arrangements.

SUMMARY OF THE INVENTION

It is an object of the present invention to provide apparatus for a screw compressor by which continuous compressor unloading can be achieved over a predetermined portion of the compressor's operating range.

It is another object of the present invention to provide a screw compressor which is capable of being modulated over a predetermined and continuous portion of its operating range in a manner which minimizes the internal clearance volumes and leakage paths associated with the compressor's piston unloader arrangement.

It is a still further object of the present invention to provide a piston unloader for a screw compressor which is less expensive of manufacture, easier to assemble/install and is not orientation-critical either with respect to the bore in which it travels or the unloader ports with which it interacts.

It is another object of the present invention to provide a piston unloader arrangement for a screw compressor which eliminates certain disadvantages and failure modes associated with previous designs for such unloading arrangements.

These and other objects of the present invention, which will become apparent when the attached drawing figures and following Description of the Preferred Embodiment are considered, are achieved by piston unloading apparatus in a screw compressor which permits the smooth and continuous unloading of the compressor over a portion of its operating range by the selective opening or occlusion of a series of generally axially running, preferably non-overlapping unloader ports which communicate between the compressor's working chamber and an unloader bore remote therefrom. The bore is also in communication with an area of the compressor which is at suction pressure when the compressor is in operation.

The end face portion of the piston unloader is of a predetermined but uniform geometry so that the piston can be disposed in the bore for axial movement without the need for any apparatus or arrangement by which to orient the piston or its end face portion for alignment with the unloader ports. The uniform geometry of the end face portion of the unloader piston is such that it permits the axially spaced, physically non-overlapping unloader ports defined along the unloader bore to, in effect, overlap in operation while providing a seal against leakage across or past the piston at the full load and full unload positions and at positions therebetween. Also, because the effect of the piston with respect to its unloading function is the same irrespective of its orientation in the unloader bore, costs associated with the unloader arrangement are reduced, both with respect to the material and assembly costs of the compressor, while certain failure modes that were associated with the need, in prior piston designs, to maintain the piston's orientation within the bore are eliminated.

DESCRIPTION OF THE DRAWINGS

FIG. 1 illustrates the screw compressor in which the unloader arrangement of the present invention is employed.

FIG. 2 is an enlarged partial view of the piston unloader arrangement of FIG. 1.

FIG. 3 is an end view of the piston unloader of the present invention taken along line 3—3 of FIG. 2.

DESCRIPTION OF THE PREFERRED EMBODIMENT

Figure 4A:
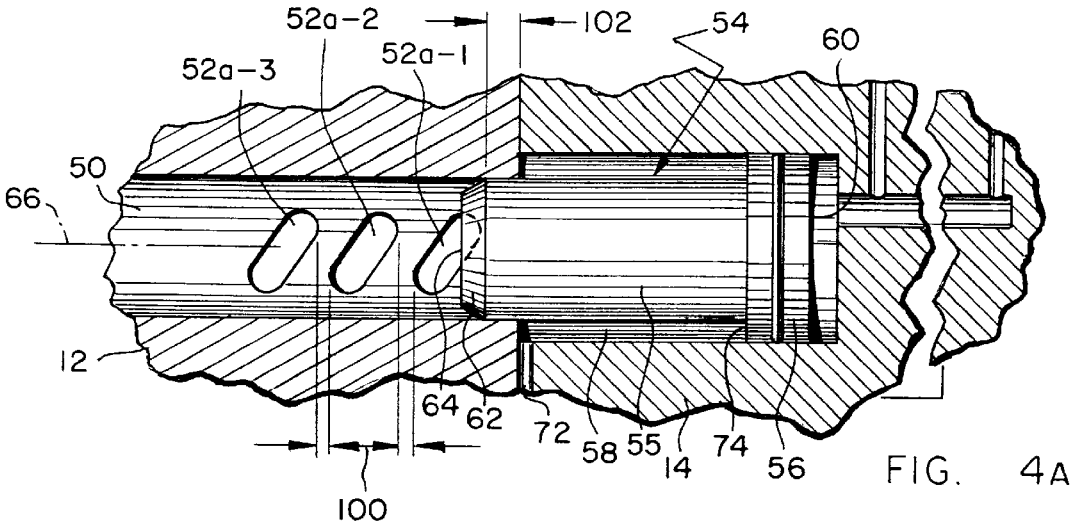
FIGS. 4*a*, 4*b* and 4*c* illustrate the unloading arrangement of the present invention with the piston unloader in full unload, intermediate and full load positions respectively.

Referring first to FIGS. 1, 2 and 3, screw compressor 10 is comprised of rotor housing 12 and bearing housing 14. Disposed in rotor housing 12 is motor 16, male rotor 18 and female rotor 20. Extending from male rotor 18 is a shaft 22 on which motor rotor 24 is mounted. It will be appreciated, therefore, that male rotor 18 is the "driven" rotor in the preferred embodiment although the female rotor could likewise function as the driven rotor. Rotation of male rotor 18, in turn, causes the counter-rotation of female rotor 20 by virtue of their meshing engagement. Compressor 10 could also be of the open drive type, open drive compressors being compressors in which the motive power by which the compressor is driven is communicated from a remote source, such as a motor or engine, which does not form part of the flow path for refrigerant gas that passes through the compressor or the system in which the compressor is employed.

Suction gas enters rotor housing 12 through rotor housing suction end 26 and passes through a suction strainer, not shown, prior to passing through and around motor 16 in a manner which cools the motor. Such gas is delivered to housing 12 from the evaporator of the refrigeration system in which compressor 10 is employed, such gas having been created by the evaporation process that occurs in the evaporator. Compressor 10 acts to pump or suck vaporized refrigerant gas from the evaporator through and around motor 16. Suction gas passing through and around motor 16 passes out of motor-rotor housing gap 28, rotor-stator gap 30 and into suction area 32 within the rotor housing. The gas next passes from suction area 32, through suction port 34 and into compressor working chamber 36 where it is enveloped in a chevron-shaped compression pocket defined by the wall of working chamber 36 and the lobes of the intermeshed male and female rotors.

As male rotor 18 and female rotor 20 rotate, compression pockets are repetitively formed within the working chamber. Each such pocket traps suction gas at "suction pressure" within the working chamber and comes to be closed off from suction port 34 by virtue of the meshed counter-rotating relationship of the screw rotors and by the occlusion of the suction port by the rotation of the rotor lobes. The compression pockets are then circumferentially displaced toward high pressure end wall 38 of working chamber 36 by the continued counter-rotation of the rotors. As such displacement occurs, the volume of a compression pocket is reduced and the gas contained therein is compressed until such time as the pocket opens to discharge port 40. The now-compressed gas is expelled therethrough at "discharge pressure".

It will be apparent that absent some means for controlling the capacity of compressor 10, gas entering working chamber 36 at suction pressure will be compressed and discharged in a predetermined volume and at a predetermined discharge pressure through discharge port 40 no matter what the required pumping capacity of the compressor is. Because actual loads on compressors and the refrigeration systems in which they are used vary and are not typically such as to require that a compressor be operated at full capacity at all times and because the operation of such compressors at full capacity, when such capacity is unneeded, is wasteful of energy, apparatus must be provided to change the pumping capacity of such compressors in a manner which will, as closely as possible, cause the compressor's output to match the then-existing need for compressed gas in the system. The need for compressed gas in the system is, in turn, a function of the demand for cooling which the system experiences at any given time, that demand, in turn, being determinative of the rate of refrigerant vaporization that occurs in the evaporator of the system in which the compressor is employed.

When the load or demand for cooling on the system increases, refrigerant vaporizes at a faster rate in the evaporator and the compressor is called upon to remove such vaporized refrigerant from the evaporator so that it can be reconditioned within the refrigeration system and returned thereto in liquid form for further use in the cooling process. When the demand for cooling is less, the compressor is called upon to pump refrigerant gas from the evaporator at a lower rate. By reducing the compressor's capacity to pump gas from the evaporator so as to match the load on the system in which it is used, less work is required of the motor, which, in turn, reduces the amount of energy consumed by the compressor.

Referring primarily now to FIG. 2 and to the piston unloader of the present invention which, in the preferred embodiment, is associated and interacts with male rotor 18, rotor housing 12 defines a bore 50 which is in flow communication with suction area 32 and/or suction port 34 or some other location in compressor 10 or the system in which compressor 10 is employed which is at suction pressure when the compressor is in operation. Rotor housing 12 also defines a series of generally axially running, physically non-overlapping unloader ports 52 along bore 50 that communicate between bore 50 and working chamber 36. Ports 52 need not necessarily be axially aligned along bore 40 and could be offset from one another around the bore. In the preferred embodiment, however, ports 52 are generally axially in-line along the bore. Disposed for movement in bore 50 is unloader piston 54 which includes a barrel portion 55 that is axially moveable in bore 50 and a control portion 56 that is axially positionable in a chamber 58. Chamber 58 is defined by bearing housing 14.

Unloader ports 52 are generally elongated curvilinear slots which open both into bore 50 and working chamber 36. Ports 52 of the present invention do not physically overlap axially along the length of bore 50 and are separated in an axial sense with respect to their opening into the compressor's working chamber and into bore 50 as is illustrated at 100 in Drawing FIG. 4*a*.

It is to be noted that while ports 52 do not physically overlap in the preferred embodiment of the present invention, circumstances are foreseeable where ports 52, due to the nature of the refrigerant used in compressor 10 or requirements associated with the casting process by which rotor housing 12 is formed might physically overlap. The unloader of the present invention will likewise function should ports 52 overlap although the present invention is primarily designed for those circumstances where the overlap of ports 52 does not occur.

It also is to be noted that the unloader port closest to the discharge end of rotor housing 12 is denominated port 52*a*-1 while the intermediate unloader port is denominated port 52*a*-2 and the port closest to the suction end of the compressor is denominated port 52*a*-3. It is also to be noted that ports 52 constitute re-expansion volumes opening into the working chamber of the compressor which are detrimental to compressor efficiency. It has been found that the non-overlapping design for such ports, as set forth herein, reduces these so-called re-expansion volumes and thus least detrimentally affect the overall efficiency of the compressor by virtue of their existence.

Figure 4B:
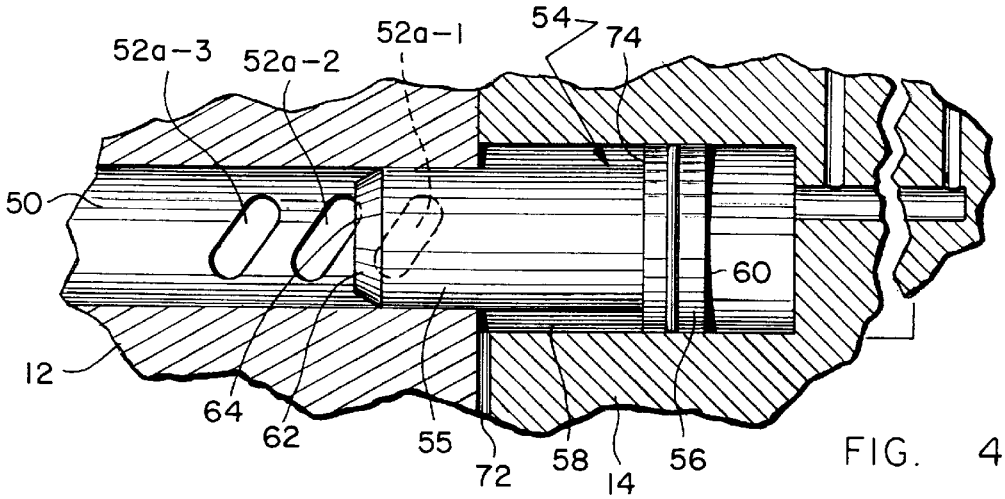
Figure 4C:
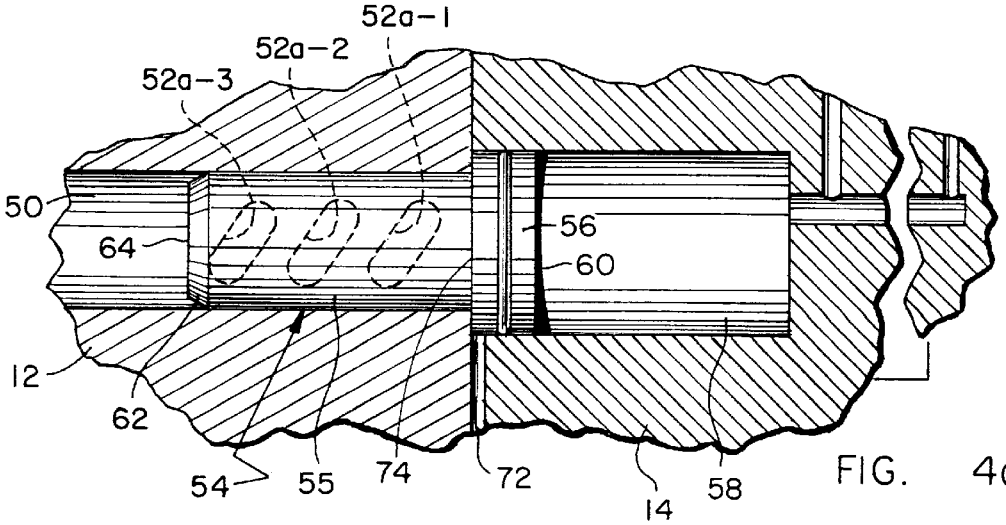

Unloader piston 54 is axially moveable and controllably positionable within bore 50 between the full unload position illustrated in FIG. 4*a* and the full load position illustrated in FIG. 4*c*. Backface 60 of control portion 56 of piston 54 is acted upon by a pressurized fluid so as to position barrel portion 55 of unloader piston 54 within bore 50 and with respect to the unloader ports. End face portion 62 of piston 54 is of a modified but uniform geometry, such geometry being, in the preferred embodiment, that of a truncated cone, so that no matter what the angular orientation of the end face 64 of piston 54 is with respect to the centerline 66 of bore 50, end face portion 62 of the unloader piston presents a uniform geometry to the unloader ports.

With the arrangement of the present invention, there is no need to maintain the angular alignment of end face portion 62 of piston 54 with respect to the unloader ports and with respect to centerline 66 of bore 50, as had been the case in prior compressors, so as to ensure that a specially defined segment of the end portion of the unloader piston is maintained in alignment with the unloader ports and is unable to rotate within the unloader bore around the centerline thereof. In prior compressors, any such rotation, if it occurred, such as through the breakage or wear of the apparatus by which piston alignment was maintained, was wasteful of energy, resulted in the misalignment of the non-uniform specially configured end portion of the piston with the unloader ports and degraded or entirely disrupted the ability of the piston unloader to smoothly load or unload the compressor in a continuous fashion.

The unloading arrangement of the present invention, on the other hand, is entirely tolerant of any such rotation and is entirely alignment insensitive with respect to the orientation of the unloader piston to the unloader ports. By eliminating the requirement to maintain the orientation of piston 54 within bore 50, the need for apparatus to maintain such orientation is eliminated, the compressor fabrication process is simplified and several failure modes/disadvantages associated with earlier piston unloader arrangements are eliminated.

It is to be noted, prior to discussing FIGS. 4*a*, 4*b* and 4*c*, that the escape of high pressure fluid from chamber 58 around or past barrel portion 55 of unloader piston 54 into bore 50 or into the working chamber through the unloader ports is counterproductive with respect to the efficiency of the compressor. That leakage is prevented by the provision of circumferential seal area 102 along the unloader bore around the circumference of barrel portion 55 of piston 54 as illustrated in FIG. 4*a*.

Control of the position of unloader piston 54 is by the application of a relatively high pressure fluid, such as oil or refrigerant gas, to end face 60 of the unloader piston or by venting such fluid from chamber 58 to unload the compressor. By exposure of end face 60 of the unloader piston to a pressurized fluid and by the venting of such fluid from chamber 58, the precise positioning of control portion 56 of unloader piston 54 within chamber 58 and, therefore, the precise positioning of barrel portion 55 of piston 54 in bore 50 is accomplished. Such precise control is achieved by the selective opening of load solenoid 68 to pressurize chamber 58 and by the opening of unload solenoid 70 in order to vent chamber 58. Control of the solenoids is, in turn, predicated on the relatively very small changes in compressor capacity which result from even very small movements of the unloader piston. Each of such changes, despite being small, are manifested by a measurable change in the current draw of motor 24. Precise control of the position of piston 54 in view of these characteristics and, therefore, precise control of the capacity of compressor 10 is readily achievable.

Referring now to FIG. 4*a*, in which piston 54 is illustrated in the "full unload" position, end face portion 62 of the unloader piston overlies a portion of unloader port 52*a*-1. In this position, end face portion 62 occludes unloader port 52*a*-1 very minimally. This very nominal/minimal loading of the compressor by piston 54, in its "full unload" position, makes the compressor immediately responsive to a demand for increased compressor capacity.

In that regard, as soon as piston 54 moves to load the compressor from this full unload piston, a portion of port 52*a*-1 will come to be occluded by barrel portion 55 of the unloader piston. As such, any movement of the unloader piston to load the compressor, from the full unload position, has the immediate effect of increasing compressor capacity as the unmodified barrel portion 55 of unloader piston 54 comes to occlude the unloader port. The affect of such occlusion is to increase the effective length of the rotor pair (the portion of the rotor set which is capable of engaging the compression process) and therefore, once again, to increase the compressor's capacity. It is to be noted that if in its "full unload" position, end face portion 62 of the unloader piston did not overlap unloader port 52*a*-1, a deadband would exist that would make control and loading of the compressor more difficult and imprecise.

Referring primarily now to FIG. 4*b*, unloader piston 54 is illustrated in an intermediate position in which both unloader ports 52*a*-1 and 52*a*-2 are overlapped by end face portion 62 of the unloader piston which maintains them in flow communication through bore 50 and makes them, in effect, overlapping unloader ports. In this position unloader ports 52*a*-1 and 52*a*-2 are each partially occluded. Any further movement of piston 54 to load the compressor such that barrel portion 55 of piston 54 comes to completely occlude unloader port 52*a*-1 results in the transfer of capacity control from port 52*a*-1 to port 52*a*-2. The transfer of capacity control from one non-overlapping port to another thus occurs in a smooth and continuous fashion where there would otherwise be a deadband as the unloader piston moved without effect between the physically separated adjacent unloader ports.

Referring next to FIG. 4*c*, unloader piston 54 is shown in the full load position wherein communication of all of unloader ports 52*a*-1, 52*a*-2 and 52*a*-3 and, therefore, the working chamber of the compressor, with bore 50 is prevented. In this position, end face portion 62 of unloader piston 54 has moved past port 52*a*-3 to a location in unloader bore 50 in which it does not interact with any of the unloader ports and, therefore, has no effect. End portion 62 of piston 54, while immediately adjacent but not in communication with unloader port 52*a*-3, is positioned such that as soon piston 54 is caused to move in a direction which unloads the compressor, by the opening of unload solenoid 70 and the venting of chamber 58, communication is re-established between the compressor's working chamber 36 and bore 50 through unloader port 52*a*-3 and compressor unloading commences.

It is to be noted, with respect to the unloading of the compressor, that chamber 58, on the side 74 of control portion 56 of piston 54 opposite backface 60 is at all times exposed to discharge pressure through a passage 72 that is in open communication with compressor discharge port 40. Therefore, when unload solenoid 70 opens and the portion of chamber 58 into which backface 60 of unloader piston 54 faces is vented to suction, discharge pressure acts on side 74 of control portion 56 of piston 54 to move the unloader piston in a direction which unloads the compressor. The respective surface areas of the sides of control portion 56 on which pressure fluid acts are such that whenever load solenoid 68 is opened, piston 54 will move in a direction which loads the compressor.

The unloading arrangement of the present invention, through the use of physically non-overlapping unloader ports which effectively overlap in operation and by the use of an unloader piston having an end face of uniform geometry, is such that continuous and smooth compressor loading and unloading is achieved while internal leakage within the compressor due to the unloading arrangement is minimized. Further, compressor efficiency is enhanced by, among other things, the minimization of the re-expansion volumes of the unloader ports. Still further, by eliminating the need to maintain the orientation of the piston unloader within the unloader bore, the need to specifically align the unloader with the unloader ports and the need for apparatus by which such alignment is achieved and maintained, heretofore unobtainable reliability and versatility in the capacity control of a more economically manufacturable, relatively small capacity screw compressor is made possible while failure modes associated with the unloader piston arrangements of earlier compressors are eliminated.

While the present invention has been described in terms of a preferred embodiment, it will be appreciated by those skilled in the art that many modifications of the present invention are contemplated hereby. Therefore, the scope of the present invention is to be limited only in accordance with the language of the claims which follow and functional equivalents thereof.

What is claimed is:

1. A screw compressor comprising:

a housing, said housing defining a working chamber, a bore remote from said working chamber and a plurality of ports communicating therebetween; and an unloader piston, said unloader piston being disposed for axial movement within said bore for loading and unloading said compressor in a continuous manner by providing an effectively uninterrupted unloading path from said working chamber to said bore through said ports, said unloader piston having an end portion of uniform geometry, said end portion of said piston being disposed in said bore at all times.

2. The screw compressor according to claim 1 wherein said ports are spaced apart so that no portion of any one of them overlaps an adjacent port along said bore and wherein the capacity of said compressor is insensitive to and unaffected by the orientation of said end portion of said piston within said bore.

3. The screw compressor according to claim 2 wherein said piston has a barrel portion and wherein the geometry of said end portion of said piston is a truncated cone, the base of said truncated cone being attached to said barrel portion of said piston.

4. The screw compressor according to claim 3 wherein said bore is in flow communication with a location in said compressor that is at suction pressure when the compressor is in operation and wherein said unloader piston is comprised of said end portion, said barrel portion and a control portion, said end portion and at least part of said barrel portion of said piston being disposed in said bore at all times, the inner surface of said bore and the exterior surface of said barrel portion of said piston cooperating to create a seal surface around the circumference of said barrel portion of said unloader, said seal surface being in existence at all times irrespective of the position of said unloader piston in said bore.

5. The screw compressor according to claim 4 further comprising a bearing housing, said bearing housing being attached to said housing which defines said working chamber, said bearing housing defining a chamber in which the control portion of said unloader piston is moveably disposed, movement of said control portion of said unloader piston in said chamber in said rotor housing causing movement of said end portion of said piston and said unloader portion of said piston in said remote bore.

6. A screw compressor comprising:

a rotor housing defining a generally axially running working chamber and an unloader bore generally parallel thereto, said working chamber and said unloader bore being in flow communication through a plurality of ports, said bore being in flow communication with a portion of said compressor which is at suction pressure when said compressor is in operation; and an unloader piston, said piston being disposed for axial movement in said bore between a full load and a full unload position and having an end face portion of uniform geometry, said end face portion of said piston presenting a consistent geometry to said unloader ports irrespective of the angular orientation of said end face portion with respect to the center line of said bore, said piston being positionable in said bore so as to provide for the continuous unloading of said compressor over a predetermined portion of said compressor's operating range.

7. The screw compressor according to claim 6 wherein said ports are axially spaced along said bore so that no portion of a first port overlaps a second port along the axis of said bore and wherein said end face portion of said piston is physically positioned so as to have no interaction or overlap with any of said plurality of ports when said piston is in said full load position.

8. The screw compressor according to claim 7 wherein said end face portion of said piston overlies at least one of said plurality of ports when said piston is in said full unload position but essentially does not impose a load on said compressor other than a very minimal load that facilitates the ability and responsiveness of said compressor to load when initially called upon to do so.

9. The screw compressor according to claim 8 wherein said piston is unrestrained from rotation in said bore around and about the center line of said bore.

10. The screw compressor according to claim 9 wherein said unloader piston additionally has a barrel portion and a control portion, said end face portion and said control portion each being connected to said barrel portion, said end face portion and at least a portion of said barrel portion being disposed at all times in said bore, said barrel portion and said bore cooperating to define a seal surface at all times irrespective of the position of said barrel portion of said piston in said bore.

11. The screw compressor according to claim 10 wherein the geometry of said end portion of said piston is a truncated cone.

12. A method for unloading a screw compressor where said compressor defines a working chamber and a bore running generally parallel thereto and where said working chamber and said bore communicate through a plurality of ports axially spaced along said bore, comprising the steps of:

disposing a piston unloader in said bore, said piston unloader having an end face portion of uniform geometry;

permitting said piston unloader to rotate within said bore around the centerline thereof;

controllably positioning said piston unloader and the end face portion thereof axially in said bore in and between a full load and a full unload position in accordance with the load on said compressor.

13. The method according to claim 12 wherein said ports are physically non-overlapping along said bore and wherein the end face portion of said piston is connected to a barrel portion of said piston and comprising the further step of moving the end face portion of said piston out of registry with said non-overlapping ports and occluding said non-overlapping ports with the barrel portion of said unloader piston in order to fully load said compressor.

14. The method according to claim 13 comprising the further step of withdrawing all but the end face portion and a relatively small portion of the barrel portion of said piston unloader from said bore in order to unload said compressor to the maximum extent possible, none of said non-overlapping ports being occluded by any portion of the barrel portion of said unloader piston when said compressor is fully unloaded.

15. The method according to claim 14 comprising the further step of defining a circumferential seal area between the barrel portion of said unloader piston and said bore, said seal area being defined at all times and irrespective of the position of said unloader piston in said bore.

16. The method according to claim 15 comprising the further step of causing said physically non-overlapping ports to overlap in effect by placing the end face portion of said piston unloader in registry with adjacent ones of said physically non-overlapping ports within said bore.

* * * * *